US006105670A

United States Patent [19]

Klos et al.

[11] Patent Number: 6,105,670

[45] Date of Patent: Aug. 22, 2000

[54] INJECTION/ISOLATION TOOL

[75] Inventors: Robert G. Klos, Calgary; Dale W. Peterson, Cayley; Charles E. Peppard; Kim W. Kappler, both of Calgary; David A. Hill, Bragg Creek; Colin A. Aldridge, Okotoks, all of Canada

[73] Assignee: Kudu Industries Inc., Calgary, Canada

[21] Appl. No.: 09/056,692

[22] Filed: Apr. 8, 1998

[30] Foreign Application Priority Data

Nov. 14, 1997 [CA] Canada ..... 2221062

[51] Int. Cl.[7] ..... E21B 43/40

[52] U.S. Cl. ..... 166/265; 166/305.1; 166/106

[58] Field of Search ..... 166/313, 265, 166/306.1, 386, 100, 105.1, 106

[56] References Cited

U.S. PATENT DOCUMENTS

| | | | |
|---|---|---|---|
| 3,361,204 | 1/1968 | Howard et al. | 165/305.1 |
| 3,865,188 | 2/1975 | Doggett . | |
| 4,766,957 | 8/1988 | McIntyre | 166/265 |
| 4,842,074 | 6/1989 | Hines et al. | 166/305.1 |
| 5,242,922 | 9/1993 | Burton . | |
| 5,366,011 | 11/1994 | Jennings, Jr. | 166/265 |
| 5,579,838 | 12/1996 | Michael | 166/106 |
| 5,816,326 | 10/1998 | Slater | 166/105.5 |
| 5,913,363 | 6/1999 | Paplinski | 166/265 |

FOREIGN PATENT DOCUMENTS 2208725 2/1997 Canada .

*Primary Examiner*—William Neuder
*Attorney, Agent, or Firm*—Bennett Jones

[57] ABSTRACT

A downhole tool is described which can be used for injection of waste fluids which have been separated from desired production fluids into a disposal formation. When desired, the conduit for the waste fluids to the disposal formation can be closed off, thereby isolating the disposal formation from the production zone and providing access selectively to the production zone. The downhole tool includes an inner tube having a bore and being connectable at each end to a tubing string; an outer tube having a outer surface and being disposed about and spaced from the inner tube; an annulus between the inner tube and the outer tube; upper and lower openings from the outer surface of the outer tube to the annulus; an upper well sealing means disposed on the outer tube below the upper opening for providing an annular seal between the casing and the outer tube; a lower well sealing means disposed on the outer tube above the lower opening for providing an annular seal thereabout; a transverse port positioned on the tool between the upper well sealing means and the lower well sealing means, the transverse port extending to provide access between the bore of the inner tube and the outer surface of the outer tube without opening into the annulus; and a means for opening and closing the transverse port.

21 Claims, 4 Drawing Sheets

INJECTION/ISOLATION TOOL

FIELD OF THE INVENTION

This invention is directed to a downhole tool and method for use thereof and, in particular, a tool and method for downhole isolation and injection.

BACKGROUND OF THE INVENTION

In the production of oil and/or gas, in addition to the production of the desired fluid, sometimes a heavier fluid is produced. These heavier fluids must be separated from the oil and gas and disposed of.

Preferably, the undesired heavier fluids are separated from the desired fluids downhole and are injected into a disposal formation without being brought to ground surface. Where the disposal formation is located above the production formation, an uphole injection tool is required to be used to effect such downhole separation.

An uphole injection tool is disclosed in U.S. Pat. No. 5,579,838 of Michael. The tool which is disclosed handles the lighter fluids and heavier fluids separately after they have been separated by residence time downhole. The tool includes an assembly having a first conduit for movement of heavy fluids and a second conduit for movement of lighter fluids. A pump is provided for moving the heavier fluids. The first conduit opens via a plurality of ports into a disposal formation for injection of the heavier fluids thereto.

The tool of Michael has limited use however as the ports to the disposal formation are permanently open. These ports prevent isolation of the disposal formation from the production formation and limit selective access to the production formation by some tools and by fluids injected from the surface.

An uphole injection tool is required that can also be used to selectively isolate the disposal zone from the other zones.

SUMMARY OF THE INVENTION

A downhole tool has been invented which can be used for injection of waste fluids which have been separated from the desired production fluids into a disposal formation. When desired, the conduit for the waste fluids to the disposal formation can be closed off, thereby isolating the disposal formation from the production zone and providing access selectively to the production zone.

In accordance with a broad aspect of the present invention, there is provided a downhole tool for positioning in a borehole, the tool comprising: an inner tube having a bore and being connectable at each end to a tubing string; an outer tube having a outer surface and being disposed about and spaced from the inner tube; an annulus between the inner tube and the outer tube; upper and lower openings from the outer surface of the outer tube to the annulus; an upper well sealing means disposed on the outer tube below the upper opening for providing an annular seal about the outer tube; a lower well sealing means disposed on the outer tube above the lower opening for providing an annular seal about the outer tube; a transverse port positioned on the tool between the upper well sealing means and the lower well sealing means, the transverse port extending to provide access between the bore of the inner tube and the outer surface of the outer tube without opening into the annulus; and a means for opening and closing the transverse port.

In accordance with another broad aspect of the present invention, there is provided a downhole tool comprising: an inner tube having a bore with a known cross sectional area and being connectable at each end to a tubing string; an outer tube having an outer surface and being disposed about and spaced from the inner tube; an annulus between the inner tube and the outer tube; upper and lower openings from the outer surface of the outer tube to the annulus; an upper well sealing means disposed on the outer tube below the upper opening for providing an annular seal about the outer tube; a lower well sealing means disposed on the outer tube above the lower opening for providing an annular seal about the outer tube; a transverse port positioned on the tool between the upper well sealing means and the lower well sealing means, the transverse port extending to provide access between the bore of the inner tube and the outer surface of the outer tube without opening into the annulus; and, the tool defining a waste liquid conduit having a minimum cross sectional area and the transverse port having a minimum cross sectional area equal to or greater than the waste liquid conduit minimum cross sectional area of the tool.

In accordance with yet another broad aspect of the present invention, there is provided a downhole tool for use within a casing of a well, the downhole tool comprising: an inner tube having a bore and an outer surface and being connectable at each end into a tubing string, the inner tube defining a fluid conduit cross sectional area between the outer surface of the inner tube and the casing in which the downhole tool is used; an outer tube having an outer surface and being disposed about and spaced from the inner tube; an annulus between the inner tube and the outer tube, the annulus having a minimum cross sectional area which is greater than or equal to 17% of the fluid conduit cross sectional area; upper and lower openings from the outer surface of the outer tube to the annulus; an upper well sealing means disposed on the outer tube below the upper opening for providing an annular seal about the outer tube; a lower well sealing means disposed on the outer tube above the lower opening for providing an annular seal about the outer tube; a transverse port positioned on the tool between the upper well sealing means and the lower well sealing means, the transverse port extending to provide access between the bore of the inner tube and the outer surface of the outer tube without opening into the annulus.

In accordance with yet another broad aspect of the present invention there is provided a method for passing waste fluids through a well borehole from a production layer to a disposal layer disposed above the production layer, the well borehole having a wall extending from surface, comprising: providing a downhole tool including an inner tube having a bore and being connectable at each end to a tubing string; an outer tube having a outer surface and being disposed about and spaced from the inner tube; an annulus between the inner tube and the outer tube; upper and lower openings from the outer surface of the outer tube to the annulus; an upper well sealing means disposed on the outer tube below the upper opening for providing an annular seal between the borehole wall and the outer tube; a lower well sealing means disposed on the outer tube above the lower opening for providing an annular seal between the borehole wall and the outer tube; a transverse port positioned on the tool between the upper well sealing means and the lower well sealing means, the transverse port extending to provide access between the bore of the inner tube and the outer surface of the outer tube without opening into the annulus and a means for opening and closing the transverse port; connecting the inner tube to a lower tubing section including a pump; positioning the tool and the lower tubing section in the borehole such that the pump is in pumping communication with waste fluids passing from the production zone; setting the upper sealing means and the lower sealing means to seal between the outer tube and the borehole wall, the upper sealing means and the lower sealing means being disposed around an access point to a disposal zone; activating the pump to move waste fluids through the inner tube bore and out the transverse port into the disposal zone when the port is open.

In accordance with yet another broad aspect of the present invention there is provided a method for passing waste fluids through a well borehole from a production layer to a disposal layer disposed above the production layer, the well borehole having a wall extending from surface, comprising: providing a downhole tool including an inner tube having a bore and being connectable at each end to a tubing string; an outer tube having an outer surface and being disposed about and spaced from the inner tube; an annulus between the inner tube and the outer tube; upper and lower openings from the outer surface of the outer tube to the annulus; an upper well sealing means disposed on the outer tube below the upper opening for providing an annular seal between the casing and the outer tube; a lower well sealing means disposed on the outer tube above the lower opening for providing an annular seal thereabout; a transverse port positioned on the tool between the upper well sealing means and the lower well sealing means, the transverse port extending to provide access between the bore of the inner tube and the outer surface of the outer tube without opening into the annulus; connecting the inner tube at its lower end to a lower tubing section including a pump, the bore of the inner tube, the lower tubing section and the pump defining a waste liquid conduit, the waste liquid conduit having a minimum cross sectional area, the tool being selected such that the minimum cross sectional area of the transverse port is equal to or great than the minimum cross sectional area of the waste liquid conduit; positioning the tool, upper tubing section and lower tubing section in the borehole such that the pump is in pumping communication with waste fluids passing from the production zone;setting the upper sealing means and the lower sealing means to seal between the outer tube and the borehole wall, the upper sealing means and the lower sealing means being disposed around an access point to a disposal zone; and activating the pump to move waste fluids through the inner tube bore and out the transverse port into the disposal zone.

In accordance with yet another broad aspect of the present invention there is provided a method for passing waste fluids through a well borehole from a production layer to a disposal layer disposed above the production layer, the well borehole having a wall extending from surface, comprising: providing a downhole tool including an inner tube having a bore and an outer surface and being connectable at each end into a tubing string, the inner tube defining a fluid conduit cross sectional area between the outer surface of the inner tube and the wall of the borehole in which the downhole tool is used; an outer tube having an outer surface and being disposed about and spaced from the inner tube; an annulus between the inner tube and the outer tube, the annulus having a minimum cross sectional area which is greater than or equal to 17% of the fluid conduit cross sectional area; upper and lower openings from the outer surface of the outer tube to the annulus; an upper well sealing means disposed on the outer tube below the upper opening for providing an annular seal between the borehole wall and the outer tube; a lower well sealing means disposed on the outer tube above the lower opening for providing an annular seal between the outer tube and the borehole wall; a transverse port positioned on the tool between the upper well sealing means and the lower well sealing means, the transverse port extending to provide access between the bore of the inner tube and the outer surface of the outer tube without opening into the annulus, the transverse port having a minimum cross sectional area equal to or greater than the cross sectional area of the bore of the inner tube; connecting the inner tube to a lower tubing section including a pump; positioning the tool, and the lower tubing section in the borehole such that the pump is in pumping communication with waste fluids passing from the production zone; setting the upper sealing means and the lower sealing means to seal between the outer tube and the borehole wall, the upper sealing means and the lower sealing means being disposed around an access area to a disposal zone; and activating the pump to move waste fluids through the inner tube bore and out the transverse port into the disposal zone.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
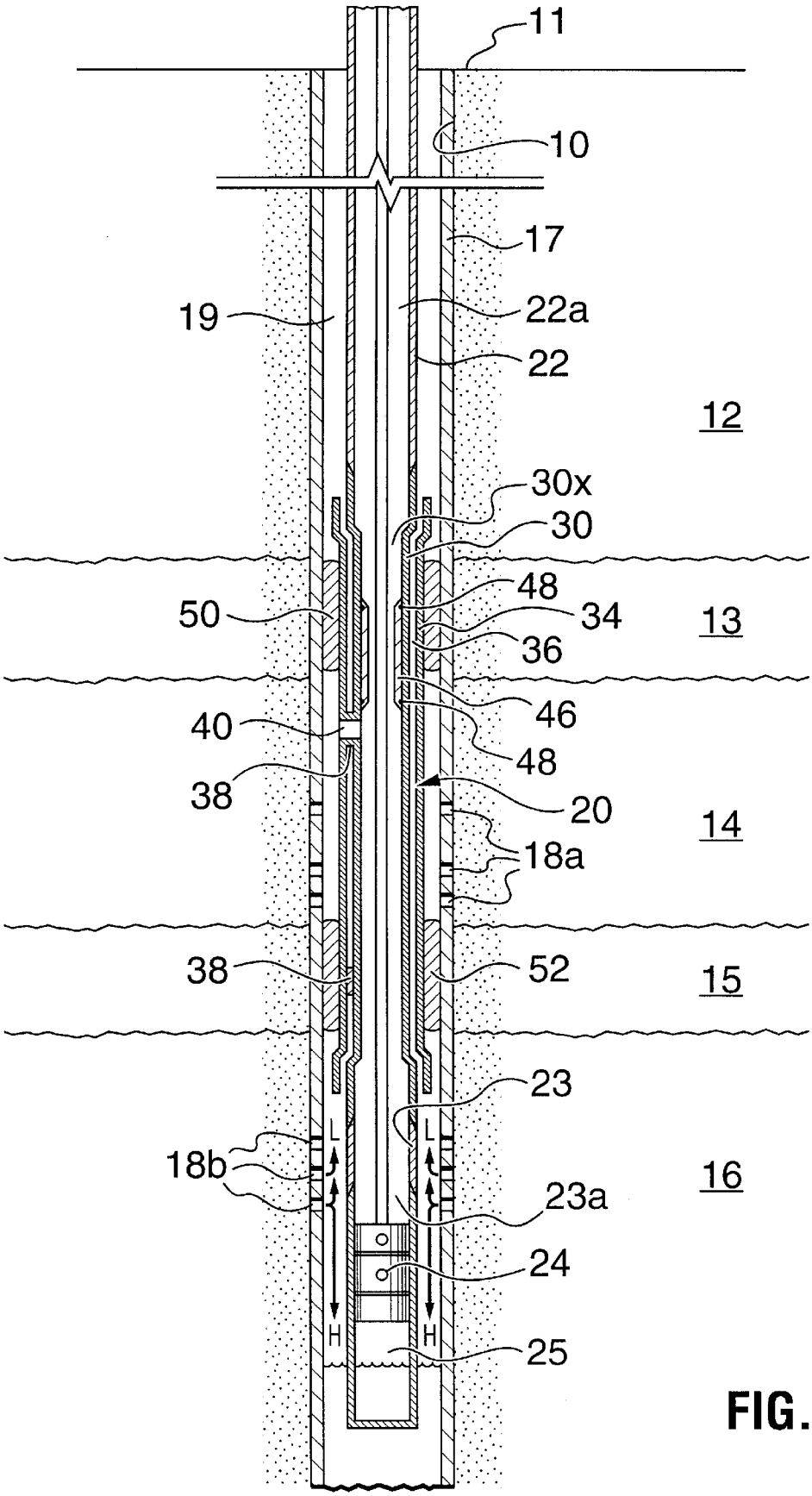
FIG. 1 shows a schematic representation of a vertical section along a cased borehole, the borehole having an injection/isolation tool disposed therein.

Referring to FIG. 1, a sectional schematic view along a well is shown. The well borehole, indicated at 10, passes from surface 11 through a formation including an upper layer 12, an impermeable rock layer 13, a disposal layer 14 which is permeable rock, a second impermeable layer 15 and a production layer 16. Borehole 10 is lined with a casing 17 and is completed to prevent interzonal migration in the casing annulus. Upper perforations 18*a* are formed in casing 17 to provide access from the casing tube to the disposal layer 14 and lower perforations 18*b* are formed in casing 17 to provide access to production layer 16. The production layer 16 produces both a desired lighter fluid, such as oil and/or gas, and a heavier waste fluid, such as water. Both the fluids pass from the production layer through perforations 18*b* into casing 17. After a suitable residence time in the casing, for example one minute, the lighter fluids, such as gas, will be separated from the heavier fluids. These lighter fluids, will pass by the forces of density and pressure up the borehole, as indicated by arrows L. Lighter fluids such as oil may require active separation from the waste fluids and may further require active pumping up the borehole after they are separated from the heavier fluids. The heavier fluids will pass by gravity further down the borehole, as indicated by arrows H.

The injection/isolation tool according to the present invention is shown schematically in FIG. 1 and is generally indicated as 20. Tool 20 provides a conduit for lighter fluids moving towards surface 11 and injects heavier fluids into disposal layer 14. The tool can alternately be used to isolate a portion of the casing or well bore from the remainder of the casing or well bore while remaining a conduit to fluids moving towards surface 11. For use, tool 20 is preferably connected at its upper end into an upper tubing string 22 and, at its lower end, to a lower tubing string 23 preferably to which is attached or includes a pump 24. Pump 24 can be any suitable pump for downhole operation such as, for example, a rod pump, as shown, a progressing cavity pump or an electric submersible pump. The pump includes an inlet port 25 which provides access to the bore 23*a* of tubing string 23.

Tool 20 includes an inner tube 30 connectable directly to tubing strings 22 and 23 such that the inner bore 30*x* of inner tube 30 opens into the inner bores 22*a* and 23*a* of tubing strings 22 and 23 and a unitary conduit is formed through the tubing strings 22, 23 and tube 30. Tubing strings 22 and 23 and tube 30 are connected in any suitable way such as, for example, by standard tubing collars, threaded and/or non-threaded connections.

An outer tube 34 is mounted substantially concentrically about inner tube 30. Outer tube 34 is mounted in spaced relation from inner tube 30 such that an annulus 36 is formed there between. Inner tube 30 and outer tube 34 are mounted together and annulus 36 is formed by any desired process such as by milling along the length of a wall of a tube to form an inner tube and an outer tube which are connected and have an annulus there between. Alternately, and as shown in the depicted embodiment, spacers 38 are secured between inner tube 30, and outer tube 34, for example by welding or fasteners, to maintain the spacing there between. Spacers 38 are disposed between the tubes such that annulus 36 is not at any point completely blocked off and an open path is provided through the annulus between the lower and upper ends of tubes 30, 34.

The tool also includes at least one transverse port 40 which extends between and connects the inner bore 30*x* of inner tube 30 to the outside of the tool without opening into the annulus 36. Each port 40 is formed in any suitable way, for example by placing a tube in sealing arrangement between openings formed in inner tube 30 and outer tube 34. Where a spacer 38 is used to form annulus 36, port 40 can be formed conveniently by drilling an opening through the spacer, as shown. In so doing, it is necessary that a seal be provided at the interface between the spacer and the tubes, where the port passes, to prevent passage of fluid from the port through the interface.

A means is provided for selectively opening and closing port 40. In the illustrated embodiment, a sliding sleeve valve 46 is mounted on tool to provide for closure of port. Sleeve 46 is disposed in the bore 30*x* of inner tube 30 and is moveable in the bore between a position in which port 40 is not blocked by sleeve 46 and a position in which sleeve 46 is disposed over and blocks port 40. Sealing means 48, such as O-rings or lip seals, are provided to effect a seal between sleeve 46 and tube 30.

Well sealing means 50, 52, such as packers, are provided on the exterior of tube 34 for effecting a seal between tube 34 and casing 17. Sealing means 50 is provided adjacent the upper end of tube 34, while sealing means 52 is provided adjacent the lower end of tube 34. Sealing means 50, 52 can be a packer or any other sealing means which can be placed around a tube to block passage of fluid about the tool and through the well bore. Preferably, the sealing means are retractable so that the well bore seal can be removed, permitting the tool to be removed from the well. For example, the sealing means can be an inflatable/deflatable or a mechanical packer.

Figure 2A:
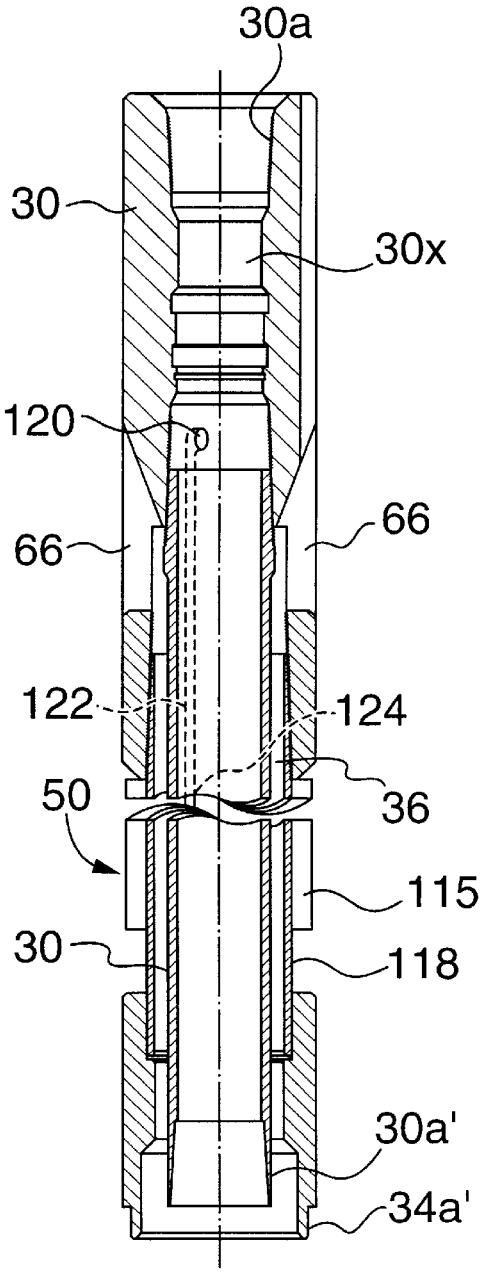
FIGS. 2A, 2B, 2C and 2D show front elevations of an injection/isolation tool according to the present invention; and, FIGS. 3A and 3B are cross sectional views along lines A and B, respectively, of FIG. 2C.
Figure 2B:
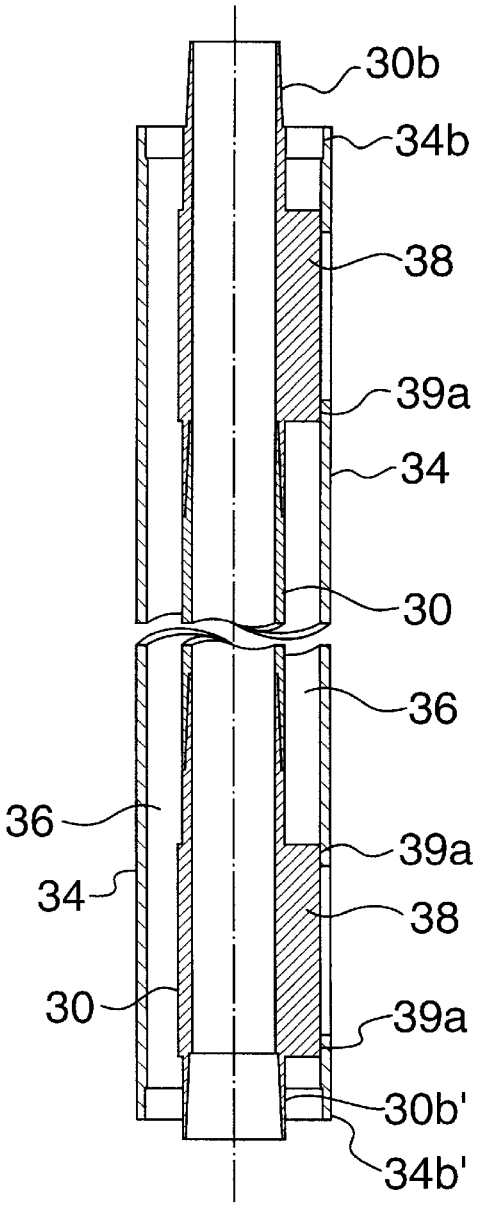
Figure 2C:
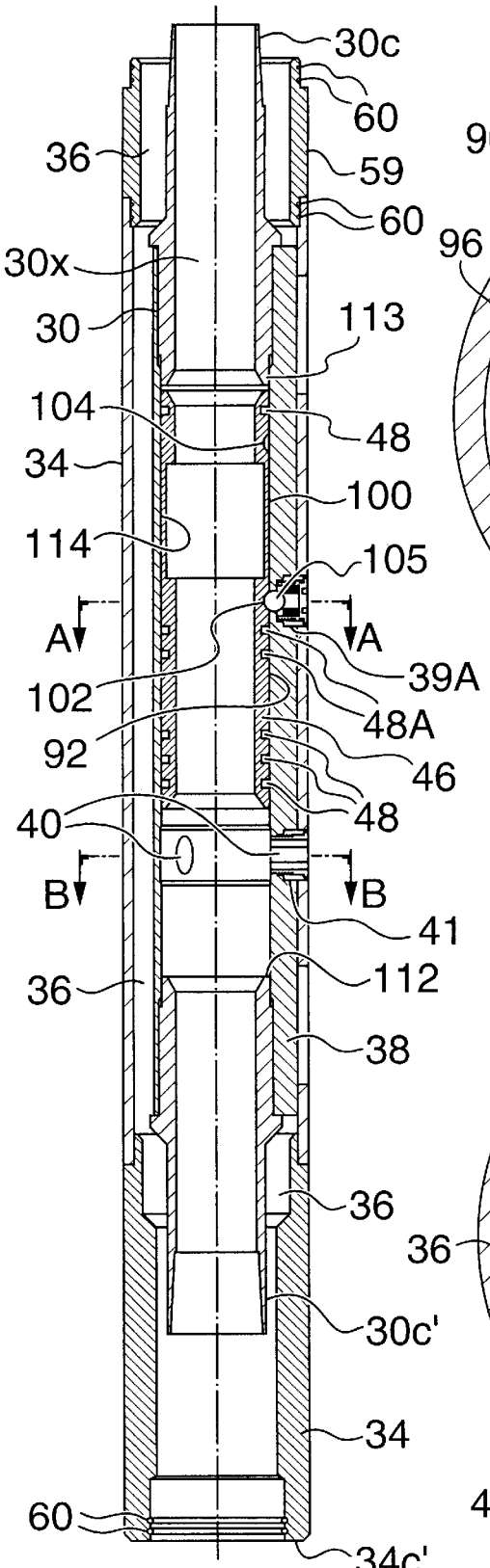
Figure 2D:
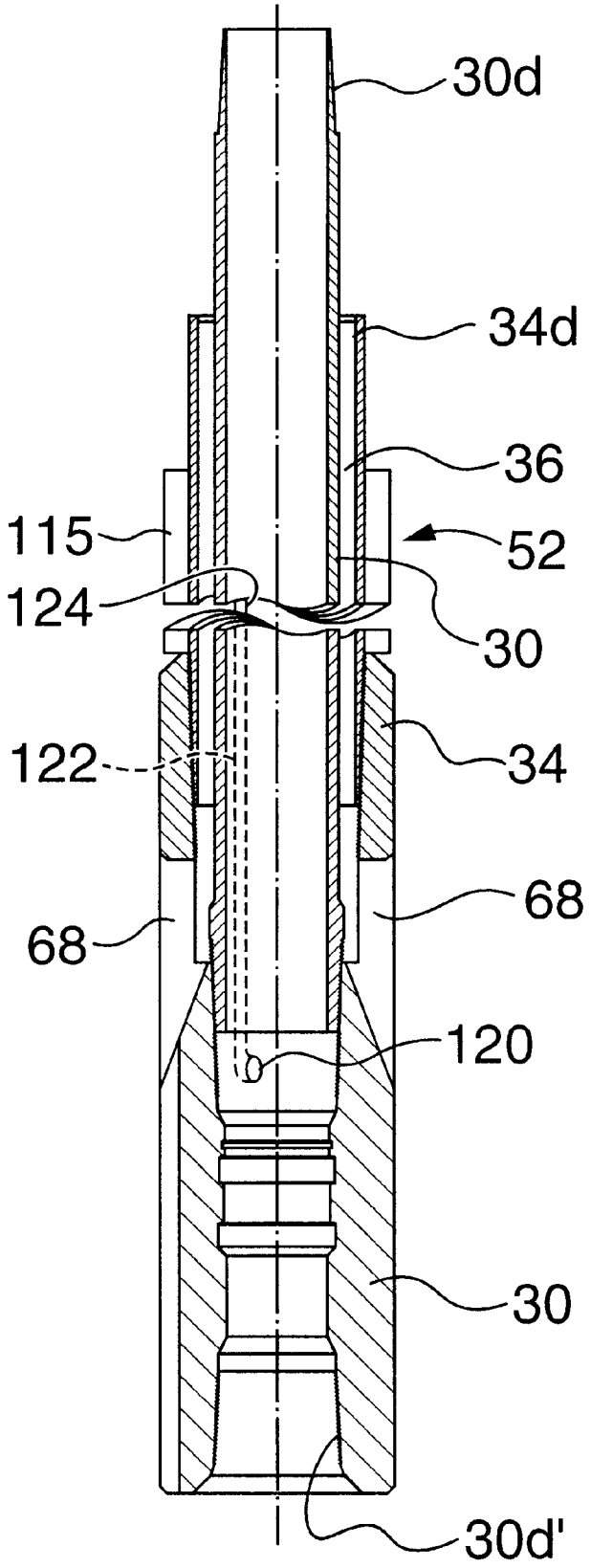

Referring to FIGS. 2A to 2D, 3A and 3B, a preferred embodiment of the tool is shown. To facilitate manufacturing of the tool and to facilitate selection of the length of the tool, the tool 20 is preferably made by assembly of about four main parts. In particular, the tool preferably includes an upper section 20*a* (FIG. 2A), an upper middle section 20*b* (FIG. 2B), a lower middle section 20*c* (FIG. 2C) and a lower section 20*d* (FIG. 2D). To assemble the tool, the sections are fit together in series. The sections of the tool are maintained in engagement preferably by threading or, for example, by welding. As would be commonly understood by a man skilled in the art, sections 20*a* to 20*d* can be formed in any suitable way, for example, by a plurality of smaller parts shaped by, for example, milling to be fit together. To simplify the description, each of the smaller parts will not be described in detail. The tool is preferably formed from a material which is substantially inert to well fluids such as, for example, a steel alloy which is resistant to hydrogen sulphide gas.

Inner tube 30 of the tool is formed by: fitting inner tube end 30*b* of upper middle section into inner tube end 30*a'* of upper section; fitting upper end 30*c* of the inner tube from lower middle section 20*c* into end 30*b'*; and fitting end 30*d* into end 30*c'*. The sections of tube 30 are fit together by any suitable means such as by tapered fittings or seal rings which contain sealing means or which provide metal on metal seals or, where possible, threaded fittings.

Outer tube 34 is formed by fitting ends 34*a'* and 34*b*, 34*b'* and 34*c* and 34*c'* and 34*d* together and fitting connector rings, for example 59, thereover, as required. O-rings 60, or other suitable sealing means, such as metal on metal seals, are provided at the connections to effect a seal against the passage of fluids through the joints.

Ends 30*a* and 30*d* of tube 30 are formed for threaded connection into a tubing string.

Outer tube 34 is mounted about and spaced from inner tube 30 by spacers 38. The spacers are preferably formed integral with inner tube 30 and outer tube 34 is welded, indicated at 39*a* and 39*b*, thereon. Slots can be provided or formed in outer tube 34 to facilitate such welding. Weld 39*b* is preferably made such that it effects a seal at the interface between spacer 38 and outer tube 34. Such a weld can conveniently be made by welding through a small port formed in the outer tube. After welding the parts together, preferably, three ports 40 are formed, as by drilling, through the spacers to provide access between bore 30*x* of inner tube 30 and the outer surface of outer tube 34. To provide a secondary seal at the interface of the spacer and the outer tube where port 40 passes there through, preferably, port 40 is threaded and a liner 41 is secured therein.

To facilitate use of the tool in moving a fluid to a disposal layer, the ports are preferably formed such that their combined minimum cross sectional area is substantially equal to or greater than the minimum cross sectional area of the bore of the waste liquid conduit conveying fluid from the pump to ports 40. The waste liquid conduit of the tool shown in FIG. 1 includes the bore of inner tube 30, the bore of tubing string 23 and the tubing bore of pump 24. The minimum cross sectional area of the waste liquid conduit can be located at any position along the length of the conduit. In one embodiment of a tool according to the present invention, a pump is used which has a tubing of 2.375 in. OD and an inner bore of 2.835 in.$^2$. In that tool, the inner bore of the pump tubing represents the minimum cross sectional area of the waste liquid conduit and the tool is selected to have three transverse ports 40 each having a cross sectional area of 0.935 in.$^2$, for a total combined sectional area for the three ports of about 2.835 in.$^2$. Selecting the total combined cross sectional area of the transverse ports to be substantially equal to or greater than the minimum cross sectional area of the waste liquid conduit provides that tool operates to move waste liquid in a more efficient manner and pressure variations across the tool are not created. The cross sectional area of bore 30*x* is also 2.835 in.$^2$ to further facilitate passage of fluids.

Figure 3A:
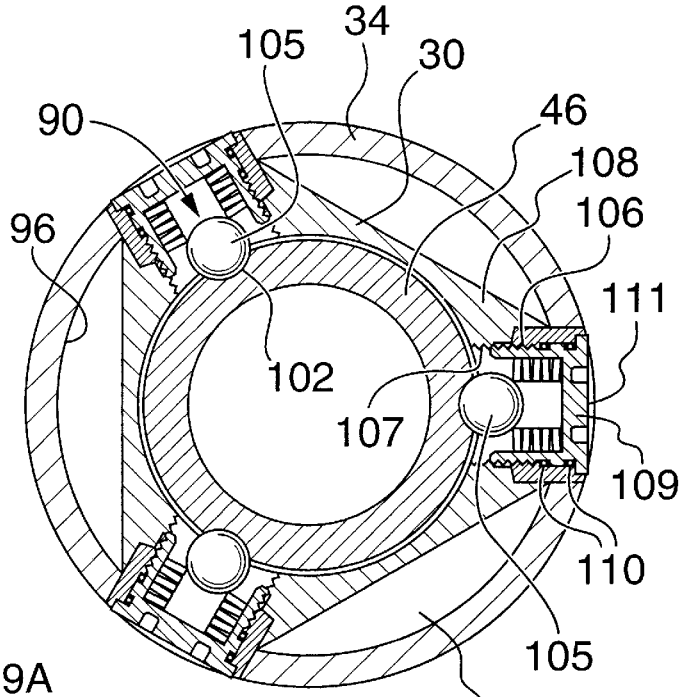
Figure 3B:
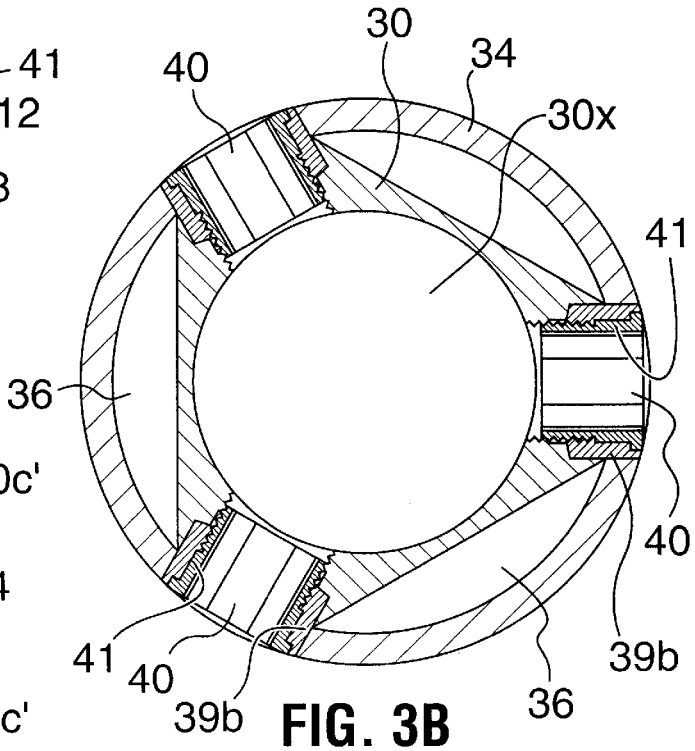

Annulus 36 is formed between the tubes 30, 34. Annulus 36 opens to the exterior of the tool at openings 66, 68. In one embodiment, the cross sectional area of the annulus is maximized in the tool to facilitate passage of gas there through and to provide the lowest pressure drop across the tool. Preferably, the minimum cross sectional area of annulus 36 is selected to be equal to or greater than 17% of the minimum cross sectional area of the fluid conduit through the borehole. The fluid conduit in a borehole is generally the annulus 19 (FIG. 1) between the tubing string, for example 22, or the inner tube 30 and the casing 17. In the illustrated embodiment, the minimum cross sectional area of annulus 36 is depicted in FIG. 3A. The minimum cross sectional area of the annulus is where the walls of transverse ports 40 are located. In a well having a 5.5" ID casing and a 2.375" OD tubing string, the annulus between tubing string and the casing wall is 14.815 in.$^2$. A preferred tool for such a well has a minimum cross section annulus (36) area of 2.6 in.$^2$ which is 17.5% of the area of the annulus between the casing and the tubing string. The maximum cross sectional area of the annulus between the outer tube and the inner tube that can be achieved in a tool according to the present invention is dependent on a number of factors including the diameter of the tool which can reasonably be expected to fit into the well, the thickness of the material which is used for construction of the tool and the diameter of the inner bore which is required.

Sliding sleeve 46 is disposed within tube 30 and is slidably moveable therein between a first position in which the sleeve does not block ports 40 and the ports are open, as shown in FIGS. 2C and 3C, and a second position in which sleeve 46 is disposed over and blocks ports 40. In accordance with the present invention, the ports can be opened by sliding the sleeve longitudinally or rotationally. Preferably, the opposing surfaces of the sleeve and tube are plated with a suitable material such as nickel to resist corrosion. In the illustrated embodiment, the sleeve is moved by sliding it longitudinally within tube 30. Circumferential sealing elements 48, such as O-rings, are housed in slots formed at least adjacent the ends of the sleeve thereby substantially preventing leakage of fluid between the sleeve and the tube. The seals can also act as cylinder wipers to reduce the likelihood of foreign material entering between the sleeve and the tube.

A mating assembly is provided to guide the sleeve 46 between the first and second positions. The assembly includes at least one, and preferably three, detents extending from the internal surface 96 of tube 30 into corresponding guide slots 100 in an external surface 92 of sleeve 46. Each detent preferably includes a ball 105 biased towards its slot 100 and indentations 102, 104 by an elastic member, such as for example, spring 105, as shown, or rubber blocks. A first indentation 102 and a second indentation 104 in the slots 100 are snap engaged by ball 105, as will be described below, when the sleeve 46 reaches the first and second positions, respectively. Thus, a positive indication is provided when the sleeve is retracted fully from over the ports 40 and when the sleeve is positioned over the ports. While the mating assembly has been described and shown according to one embodiment, the assembly 90 can take other forms. For example, the assembly can comprise at least one and preferably a plurality of protrusions such as pins or balls, extending from an external surface 92 of the sleeve 46 or an internal surface 96 of the tube 30. The groove can be formed on either the internal surface 92 or the external surface 96 to matingly receive the protrusions. Alternately, a rotationally moveable sleeve can be provided and a suitable sleeve positioning means for such a rotatably moveable sleeve can be used.

Preferably, the detent assemblies including balls 105 and springs 106 are accessible from the exterior of the tool. For example, in the depicted embodiment, each ball and spring assembly is disposed in a port 107 in the tool which extends though the outer tube 34, through a solid spacer 108 disposed in the annulus and through the inner tube 30. Ports 107 are preferably formed in a manner similar to ports 40. In the illustrated embodiment, solid spacer 108 is formed integral with inner tube 30. Each detent includes a generally cylindrical plug 109 which is threadably engaged in port 107. Seals 110 are provided to seal between plug 109 and port 107. The plug has a first end 111 which is open to the exterior of the tool. The elastic members act against the plugs 109 to bias the spherical members 105 towards slots 100. The removability of plugs 109, allows the tension in the elastic members to be adjusted, or the springs to be replaced, to thereby adjust the threshold actuation force necessary to move the sleeve 46 without disassembly of the tool.

Sleeve 46 is limited in its range of movement within tube 30 by shoulders 112, 113. The sleeve is moved between the first and the second position by a downhole tool (not shown), as is known. For example, the downhole tool include a housing having spring loaded dogs mounted therein adapted to fit within a groove 114 formed in the inner surface of the sleeve 46. The tool engages the sleeve when the dogs spring from the housing into the groove. The sleeve is then moveable between the first and second positions, as the tool is moved, e.g. as the tool is fed into or out of the well by way of tubing extending from the tool to the surface.

Tool 20 further includes a sealing member 50 at its upper end and another sealing member 52 at its lower end. The sealing members are each, in the preferred embodiment, inflatable packers. The packers include an inflatable jacket 115 which can be for example a rubber containing material such as Neoprene that is resistant to hydrocarbon fluids and other well bore fluids. Preferably the packers are mounted on sections 118 along the outer tube 34 which are of reduced outer diameter when compared to the remainder of the outer tube. This permits the jackets to be mounted in recesses in the outer tube to, thereby protect the jackets from damage during insertion of the tool into the well. To facilitate manufacture, these sections 118 are produced separately from the remainder of the outer tube and are mounted thereto. The jackets are inflated by a flowing fluid from within the tube bore 30*x*. The flowing fluid enters through opening 120 and flows through a port 122, shown in phantom, to a line 124, also shown partially in phantom, which is in communication with jacket 115. Valves (not shown) control the flow of fluid into and out of the jacket. A packer system including an inflatable jacket and a valve which is useful in the present invention is known as an Annulus Casing Packer ™ available from McAllister Petroleum Services Ltd.

Preferably, the length of tool 20 is selected, with consideration as to the borehole characteristics, such that it is longer than the length of the section perforated with perforations 18*a* through casing 17. In particular, the length of the tool is selected such that when the tool is placed in the cased borehole, port 40 is positioned adjacent disposal layer 14, packer 52 is disposed below perforations 18*a* and packer 50 is positioned above perforations 18*a* to prevent the injected fluid from moving up the annulus about the tool. Further, the pump 24 is positioned below the tool a suitable length such that it is in pumping communication with the waste fluids being produced in the production layer. This is generally a position below perforations 18*b*.

After placement of the tool, packers 50, 52 are set to seal between the tool and the casing wall or borehole wall. Where the packers are of the type requiring inflation, sleeve 46 must be in the closed position across ports 40 during packer inflation. To facilitate installation of the tool, sleeve 46 is positioned over ports 40 during placement of the tool.

If it is desired to use the tool for isolation of a zone, the sleeve 46 is moved or remains, depending on its position during tool placement and/or inflation of the packers, so that it blocks the ports 40. If it is desired to use the tool for uphole injection, the sleeve is moved or remains retracted from over ports 40 so that the ports are open for passage of fluids.

In a producing well, any produced waste fluids are separated from the produced lighter fluids by residence time. As noted previously, the lighter fluids will pass up the borehole. When the lighter fluids reach tool 20, packer 52 prevents the fluids from moving around the tool and the fluids enter annulus 36 through opening 68. Because annulus 36 is open along the length of the tool, the lighter fluids pass through the annulus and out through opening 66. The fluids then continue up the borehole towards the surface.

The waste fluids flow by gravity downwardly in the well bore. When it is desired to inject the waste fluids in a disposal formation 14, the pump is actuated to move the waste fluid. By action of the pump, the waste fluids are drawn through inlet port 25 into bore 23*a* of tubing string 23 and thereafter into bore 30*x* of inner tube 30. When the fluids reach ports 40, the fluids flow out through the ports and into the annulus between the tool and casing 17. Packer 52 prevents the fluids from passing down the well bore and packer 50 prevents the fluids from filling up the annulus. Thus, the fluids pass through perforations 18*a* in the casing and into the disposal layer.

When it is desired to introduce fluids or tools to the production layer 16, sleeve 46 can be moved to close ports 40 and thereby isolate the disposal layer from the production layer. When it is desired to resume uphole injection into the disposal layer, it is necessary to move the sleeve to open the ports to provide access to the disposal zone.

To remove the tool from the well, the packers can be reversed, for example by deflating them, and the tool can be pulled from the well. As would be understood, where uphole injection was conducted, the perforations may have to be patched to prevent leakage of the waste fluid back into the casing.

It will be apparent that many other changes may be made to the illustrative embodiments, while falling within the scope of the invention and it is intended that all such changes be covered by the claims appended hereto.

What is claimed is:

1. A downhole tool comprising:

an inner tube having a bore with a known cross sectional area and being connectable at each end to a tubing string;

an outer tube having an outer surface and being disposed about and spaced from the inner tube;

an annulus between the inner tube and the outer tube;

upper and lower openings providing access from the outer surface of the outer tube into the annulus;

an upper well sealing means disposed on the outer tube below the upper opening for providing an annular seal about the outer tube;

a lower well sealing means disposed on the outer tube above the lower opening for providing an annular seal about the outer tube;

at least one transverse port positioned on the tool between the upper well sealing means and the lower well sealing means, the at least one transverse port extending to provide access between the bore of the inner tube and the outer surface of the outer tube without opening into the annulus; and, the tool defining a waste liquid conduit having a minimum cross sectional area and the at least one transverse port having a combined minimum cross sectional area equal to or greater than the waste liquid conduit minimum cross sectional area of the tool.

2. The downhole tool of claim 1 wherein the bore of the inner tube defines a portion of the waste liquid conduit.

3. The downhole tool of claim 1 wherein a pump is attached to the inner tube and the pump defines a portion of the waste liquid conduit.

4. The downhole tool of claim 1 wherein a tubing section is attached to the inner tube and the tubing section defines a portion of the waste liquid conduit.

5. The downhole tool of claim 1 wherein there are a plurality of transverse ports and the combined minimum total cross sectional area of the plurality of transverse ports is equal to or greater than the minimum cross sectional area of the waste liquid conduit.

6. A downhole tool for use within a casing of a well, the downhole tool comprising:

an inner tube having a bore and an outer surface and being connectable at each end into a tubing string, the inner tube defining a fluid conduit cross sectional area between the outer surface of the inner tube and the casing in which the downhole tool is used;

an outer tube having an outer surface and being disposed about and spaced from the inner tube;

an annulus between the inner tube and the outer tube, the annulus having a minimum cross sectional area which is greater than or equal to 17% of the fluid conduit cross sectional area;

upper and lower openings providing access from the outer surface of the outer tube into the annulus;

an upper well sealing means disposed on the outer tube below the upper opening for providing an annular seal about the outer tube;

a lower well sealing means disposed on the outer tube above the lower opening for providing an annular seal about the outer tube;

a transverse port positioned on the tool between the upper well sealing means and the lower well sealing means, the transverse port extending to provide access between the bore of the inner tube and the outer surface of the outer tube without opening into the annulus.

7. The downhole tool of claims 1 or 6 wherein the outer tube is an open ended tube telescopically disposed around the inner tube.

8. The downhole tool of claims 5 or 6 wherein a plurality of spacers are secured between the inner tube and the outer tube to maintain the annular space.

9. The downhole tool of claim 8 wherein at least a portion of the spacers are formed integral with the inner tube.

10. The downhole tool of claim 8 wherein the at least one transverse port is formed as an opening passing through the outer tube, one spacer and the inner tube.

11. The downhole tool of any of claims 1 or 6 used for injection of a waste fluid into a disposal zone.

12. The downhole tool of any of claims 1 or 6 having a pumping means attached at an end of the inner tube.

13. A method for passing waste fluids through a well borehole from a production layer to a disposal layer disposed above the production layer, the well borehole having a wall extending from surface, comprising;

providing a downhole tool including an inner tube having a bore and being connectable at each end to a tubing string; an outer tube having an outer surface and being disposed about and spaced from the inner tube; an annulus between the inner tube and the outer tube; upper and lower openings providing access from the outer surface of the outer tube into the annulus; an upper well sealing means disposed on the outer tube below the upper opening for providing an annular seal between the casing and the outer tube; a lower well sealing means disposed on the outer tube above the lower opening for providing an annular seal thereabout; at least one transverse port positioned on the tool between the upper well sealing means and the lower well sealing means, the at least one transverse port extending to provide access between the bore of the inner tube and the outer surface of the outer tube without opening into the annulus;

connecting the inner tube at its lower end to a lower tubing section including a pump; the bore of the inner tube, the lower tubing section and the pump defining a waste liquid conduit, the waste liquid conduit having a minimum cross sectional area and, the tool being selected such that the minimum cross sectional area of the at least one transverse port is equal to or great than the combined minimum cross sectional area of the waste liquid conduit;

positioning the tool, upper tubing section and lower tubing section in the borehole such that the pump is in pumping communication with waste fluids passing from the production zone;

setting the upper sealing means and the lower sealing means to seal between the outer tube and the borehole wall, the upper sealing means and the lower sealing means being disposed around an access point to a disposal zone; and activating the pump to move waste fluids through the inner tube bore and out the at least one transverse port into the disposal zone.

14. The method of claim 13 wherein the tool includes a plurality of transverse ports and the tool is selected such that the minimum combined total cross sectional area of the plurality of transverse ports is equal to or greater than the minimum cross sectional area of the waste liquid conduit.

15. A method for passing waste fluids through a well borehole from a production layer to a disposal layer disposed above the production layer, the well borehole having a wall extending from surface, comprising;

providing a downhole tool including an inner tube having a bore and an outer surface and being connectable at each end into a tubing string, the inner tube defining a fluid conduit cross sectional area between the outer surface of the inner tube and the wall of the borehole in which the downhole tool is used; an outer tube having an outer surface and being disposed about and spaced from the inner tube; an annulus between the inner tube and the outer tube, the annulus having a minimum cross sectional area which is greater than or equal to 17% of the fluid conduit cross sectional area; upper and lower openings from the outer surface of the outer tube to the annulus; an upper well sealing means disposed on the outer tube below the upper opening for providing an annular seal between the borehole wall and the outer tube; a lower well sealing means disposed on the outer tube above the lower opening for providing an annular seal between the outer tube and the borehole wall; at least one transverse port positioned on the tool between the upper well sealing means and the lower well sealing means, the at least one transverse port extending to provide access between the bore of the inner tube and the outer surface of the outer tube without opening into the annulus, the at least one transverse port having a combined minimum cross sectional area equal to or greater than the cross sectional area of the bore of the inner tube;

connecting the inner tube to a lower tubing section including a pump;

positioning the tool, and the lower tubing section in the borehole such that the pump is in pumping communication with waste fluids passing from the production zone;

setting the upper sealing means and the lower sealing means to seal between the outer tube and the borehole wall, the upper sealing means and the lower sealing means being disposed around an access area to a disposal zone; and activating the pump to move waste fluids through the inner tube bore and out the at least one transverse port into the disposal zone.

16. The method of claim 15 wherein the outer tube is an open ended tube telescopically disposed around the inner tube.

17. The method of claim 15 wherein a plurality of spacers are secured between the inner tube and the outer tube to maintain the annular space.

18. The method of claim 17 wherein at least a portion of the spacers are formed integral with the inner tube.

19. The method of claims 17 or 18 wherein the at least one transverse port is formed as an opening passing through the outer tube, the spacer and the inner tube.

20. The method of claim 15 wherein the wall of the borehole is defined by a casing.

21. The method of any of claims 13 or 15 further comprising connecting the inner tube to an upper tubing section in communication with the surface.

* * * * *